US009285160B1

(12) United States Patent
Kang

(10) Patent No.: US 9,285,160 B1
(45) Date of Patent: Mar. 15, 2016

(54) REFRIGERATOR WITH TILTABLE DRAWER

(71) Applicant: Dongbu Daewoo Electronics Corporation, Seoul (KR)

(72) Inventor: Jun Wan Kang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/570,177

(22) Filed: Dec. 15, 2014

(30) Foreign Application Priority Data

Oct. 10, 2014 (KR) ..... 10-2014-0136702

(51) Int. Cl.

| | |
|---|---|
| ***F25D 23/00*** | (2006.01) |
| ***F25D 25/02*** | (2006.01) |
| ***F25D 23/02*** | (2006.01) |
| ***F25D 23/06*** | (2006.01) |

(52) U.S. Cl.
CPC ..... *F25D 25/025* (2013.01); *F25D 23/028* (2013.01); *F25D 23/062* (2013.01)

(58) Field of Classification Search
CPC .... F25D 23/028; F25D 23/062; F25D 25/025
USPC ..... 312/401, 402, 404, 330.1, 334.7; 62/382
See application file for complete search history.

(56) References Cited

U.S. PATENT DOCUMENTS

| | | | | | |
|---|---|---|---|---|---|
| 2,242,903 | A * | 5/1941 | Crimmel | 108/26 |
| 2,755,158 | A * | 7/1956 | Davidson | 312/404 |
| 2,839,349 | A * | 6/1958 | Culver | 312/323 |
| 3,519,319 | A * | 7/1970 | Taylor | 312/246 |
| 3,722,975 | A * | 3/1973 | Taylor | 312/334.44 |
| 5,244,272 | A * | 9/1993 | Thompson | 312/334.23 |
| 2013/0081422 | A1 * | 4/2013 | Park et al. | 62/448 |

FOREIGN PATENT DOCUMENTS

| | | |
|---|---|---|
| KR | 2019930004296 | 3/1993 |
| KR | 100222986 B1 | 7/1999 |
| KR | 1020040009208 A | 1/2004 |
| KR | 1020100023474 A | 3/2010 |

* cited by examiner

*Primary Examiner* — James O Hansen

(57) ABSTRACT

A refrigerator including a tiltable storage drawer. Guide units are disposed at opposite side walls of the storage drawer and include a pair of guide rails and guide projections extending upward from the guide rails. The drawer is installed with a pair of continuous tilting ribs having portions with different inclination orientations, which enable the drawer to be tilted at two tilting angles when the drawer is pulled outward from the housing along the guide rails. The drawer in an extended state can be automatically pushed into a retracted position in the refrigerator by the motion of the refrigerator door.

11 Claims, 3 Drawing Sheets

REFRIGERATOR WITH TILTABLE DRAWER

CROSS-REFERENCE TO RELATED APPLICATIONS

This application claims benefit and priority from Korean Patent Application No. 10-2014-0136702, filed on Oct. 10, 2014 with the Korean Intellectual Property Office, the disclosure of which is incorporated herein in its entirety by reference.

TECHNICAL FIELD

The present disclosure is related to refrigerators, and more specifically, related to refrigerator storage drawers and methods of using the same.

BACKGROUND

Typically, a refrigerator has a freezing chamber on the top and a refrigerating chamber at the bottom. At least one storage drawer, that can be pulled out from the refrigerator and pushed back in, is disposed in the freezing chamber and/or the refrigerating chamber.

However, as refrigerators are designed to be larger, it may become difficult for a short person (for example, a child) to conveniently slide a storage drawer in and out and access the items stored therein. A user may often unintentionally leave the drawer in a half-closed position due to the difficulty in reaching it.

If the drawer is not completely pushed in, the refrigerator door cannot be fully closed. This likely causes damage to the drawer, spoils the stored items, and wastes electricity.

SUMMARY

Embodiments of the present disclosure are directed toward providing a refrigerator that allows a user to conveniently access a storage drawer located in a relatively high position in the refrigerator.

Embodiments of the present disclosure are directed toward providing a refrigerator that allows a drawer in an extended state to be automatically pushed into a retracted position in the refrigerator by motion of the refrigerator door.

An exemplary embodiment of the present disclosure is a refrigerator including: a housing; a door; guide units disposed on opposite side walls of the housing, and a drawer. The guide units include a pair of guide rails and guide projections extending from the guide rails, respectively. The drawer includes a pair of tilting ribs coupled to the guide projection and configured to allow the drawer to tilt at two or more tilting angles when the drawer is pulled outward from the housing along the guide rails.

The drawer can further include a pair of wheels that can roll on the guide rails.

Each of the guide projections may further include a rotatable roller coupled to the lower surface of the tilting rib.

The pair of wheels can be disposed at both sides of the drawer and lower than the tilting rib.

Each of the pair of tilting ribs may include: a first horizontal portion oriented in parallel with the bottom of the drawer, and disposed at each of the sides of the drawer so as to be higher than the pair of wheels; a second horizontal portion which is disposed at each of the sides of the drawer and oriented higher than the first horizontal portion; and an inclined portion which connects the first horizontal portion and the second horizontal portion.

The first horizontal portion may be disposed at a front side of the drawer sidewall, and the second horizontal portion may be disposed at a center portion of the drawer sidewall.

The tilting rib may further include: a first stopper disposed proximate to the front side of the drawer and formed in a shape conformal to the upper surface of the guide projection; and a second stopper disposed proximate to the rear side of the drawer and used to block further motion of the drawer when the second stopper comes into contact with the guide projection.

The height of the first stopper is selected such that drawer is oriented horizontally when the first stopper comes into contact with the guide projection.

The first stopper can have an arcuate or semi-circular shape that opens downward.

The second stopper may be formed in a hook shape that is curved downward.

The tilting rib may have at least two strength reinforcing portions formed between an upper surface and a lower surface of the tilting rib.

The drawer can include a plurality of groove portions formed on the bottom wall of the drawer in one direction.

Another exemplary embodiment of the present disclosure provides a method of using a refrigerator, including: pulling a drawer from a housing; allowing a first stopper of a tilting rib formed on the drawer to be spaced apart from a guide projection of a guide unit formed on the housing; moving a first horizontal portion of the tilting rib formed on the drawer along the guide projection; moving the drawer along the guide projection from the first horizontal portion to an inclined portion so as to allow the drawer to be tilted at a first tilting angle; moving the drawer along the guide projection from the inclined portion to a second horizontal portion so as to allow the drawer to be tilted at a second tilting angle; and fixing the guide projection to a second stopper such that the drawer is no longer pulled outward.

The present disclosure includes a guide unit coupled to the refrigerator internal walls, and a tilting rib coupled to the guide unit such that the drawer may be tilted at least twice when pulled out, thereby allowing items to be easily put into the drawer and taken out therefrom. The sliding and tilting mechanisms advantageously provide a better user experience and enhances refrigerator durability.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
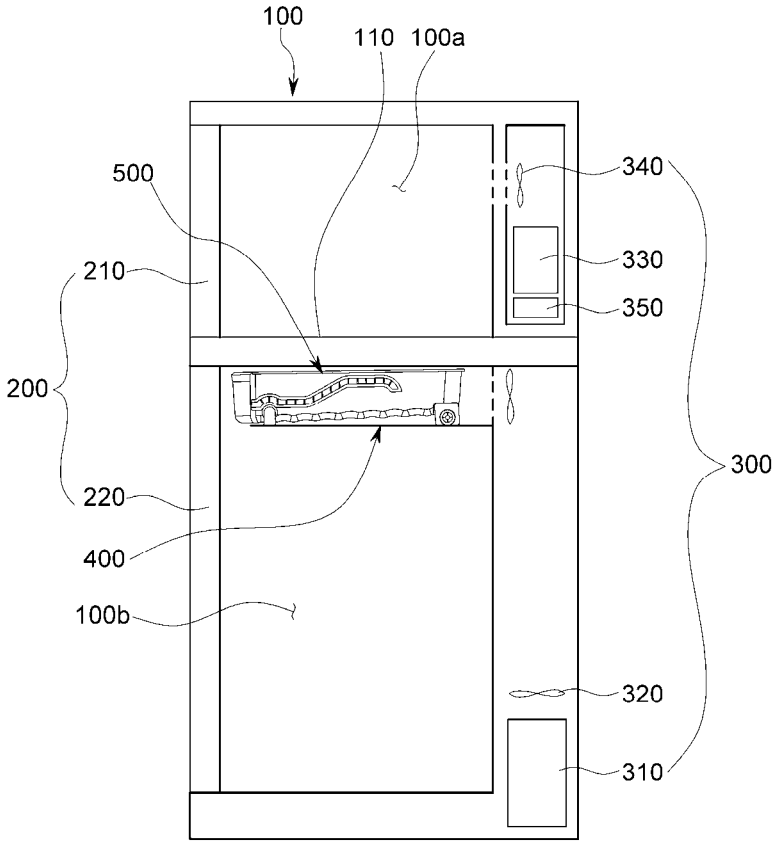
FIG. 1 is a side cross-sectional view of an exemplary refrigerator according to an embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings.

Unless particularly defined otherwise, all terms used in the present specification are the same as general meanings of the terms understood by those skilled in the art, and if the terms used in the present specification conflict with general meanings of the corresponding terms, the meanings of the terms comply with the meanings defined in the present specification.

However, the present disclosure, which is disclosed below, is intended to merely describe the exemplary embodiment of the present disclosure, but is not intended to limit the scope of the present disclosure, and like reference numerals designate like elements throughout the specification.

Figure 2:
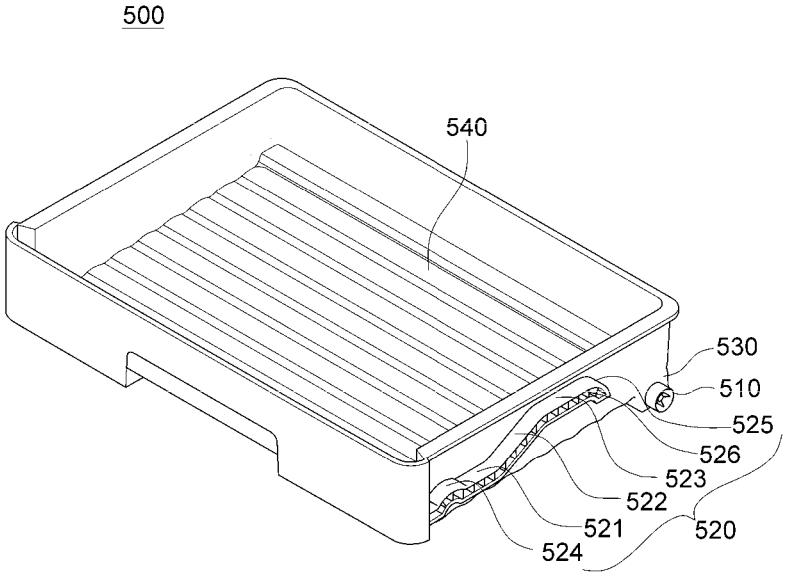
FIG. 2 is a perspective view of an exemplary drawer according to an embodiment of the present disclosure.
Figure 3:
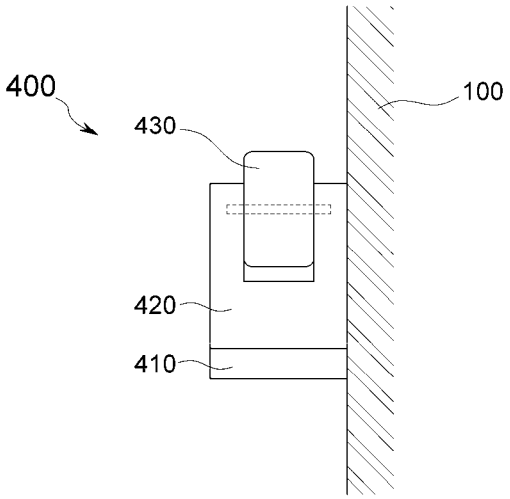
FIG. 3 illustrates an exemplary guide projection according to the exemplary embodiment of the present disclosure.

FIG. 1 illustrates a cross-sectional side view of an exemplary refrigerator according to an embodiment of the present disclosure. FIG. 2 illustrates a perspective view of an exemplary drawer according to an embodiment of the present disclosure. FIG. 3 illustrates an exemplary guide projection according to the exemplary embodiment of the present disclosure.

Referring to FIGS. 1 to 3, an exemplary embodiment of the present disclosure includes a housing 100, doors 200, a drive unit 300, guide units 400, and a storage drawer 500. The refrigerator is illustrated as a top-freezer type refrigerator, but it will be appreciated that the technical spirit of the present disclosure may also be applied to other types of refrigerators having various other configurations.

The housing 100 defines main frame of the refrigerator. The housing 100 may include an inner housing which may include a foam thermal insulator, and an outer housing made of metal or plastic.

The housing 100 has a dividing wall 110 that divides the internal space of the refrigerator into a freezing chamber 100*a* and a refrigerating chamber 100*b*.

The door 200 may be filled with a foam thermal insulator, and may be hingedly coupled to one side of the housing 100 main frame.

As the internal space of the housing 100 is divided into the freezing chamber 100*a* and the refrigerating chamber 100*b*, two doors 200 are mounted, e.g., the freezing chamber door 210 and the refrigerating chamber door 220.

A magnet may be disposed on the door 200 or the housing 100 so that the door 200 is in air-tight contact with the housing 100 when closed.

The drive unit 300 controls the temperature in the housing 100, and may be disposed on the back side of the refrigerator housing 100. Specifically, the drive unit 300 maintains a low temperature in the refrigerator by circulation of a refrigerant through compression, condensation, expansion, and evaporation processes for example. The drive unit 300 includes a compressor 310, a drain pan 320, a heat exchanger 330, a blower fan 340, and the like. The drive unit 300 may further include a heater 350 in order to remove frost produced in the evaporation process.

The guide unit 400 may include a pair of guide rails 410 horizontally disposed on opposite sidewalls of the housing 100. The guide projections 420 are located on the front sides of the pair of guide rails 410 and protrude upward.

More specifically, the pair of guide rails 410 are coupled to the sidewalls of the housing 100 by fastening means. Alternatively, the guide rails 410 can be integrated with the side walls of the housing 100 by injection molding. The drawer 500, which will be described in detail below, can be pushed into the housing 100 to a retracted position and used to contain stored items.

An upper surface of the guide projection 420 may be round shaped to reduce friction with the guide rail when the drawer 500 moves along the rails 410. The guide projection 420 may be fastened to the guide rail 410, or may be formed integrally with the guide rail 410.

Each guide projection 420 may further include a roller 430 disposed on the top of the guide projection 420. The roller 430 rotates on the lower surface of the moving tilting rib 520 when the drawer slides in or out.

According to the present disclosure, even if a user fails to manually push the drawer completely back to the retracted position, the guide projection 420 allows the motion of the closing door to push the drawer completely inside the refrigerator. This prevents damages to the door 200 or the drawer 500, prevents food deterioration, and reduces energy waste.

The drawer 500 may include a pair of wheels 510 disposed on the rear side of the drawer 500 and coupled to the guide rails 410 such that the wheels 510 move along the rails 410. The drawer 500 further includes a pair of tilting ribs 520 disposed on opposite sidewalls of the drawer 500. The tilting ribs 520 are coupled to and move on the top of the guide projections 420. The tilting ribs 520 allow the drawer 500 to have at least two tilting angles when the drawer 500 is pulled out from the housing 100.

More specifically, the pair of wheels 510 may be disposed on the opposite sidewalls of the drawer 500 and located lower than the tilting ribs 520. The wheels 510 are coupled to the drawer 500 and are lower than the bottom of the drawer 500.

The pair of wheels 510 may be detachably fastened to the drawer 500 so that the wheels 510 may be easily replaced when needed. To this end, couplers 530 for mounting the pair of wheels 510 may be disposed on the drawer 500. The couplers 530 may be formed integrally with the drawer 500 when the drawer 500 is formed by injection molding.

Therefore, according to the present disclosure, the pair of wheels 510, in conjunction with the rollers 430 disposed on the guide projections 420, allow the drawer 500 to smoothly slide in-and-out from the refrigerator even when the drawer is subject to only a relatively small external force.

Each tilting rib 520 may include a first horizontal portion 521, a second horizontal portion 523 and an inclined portion 522. When the drawer 500 is in the retracted position, the first horizontal portion 521 is oriented horizontally with reference to the refrigerator and positioned higher than the pair of wheels 510, and the second horizontal portion 523 is positioned higher than the first horizontal portion 521. The inclined portion 522 is disposed in between the first horizontal portion 521 and the second horizontal portion 523.

Here, the first horizontal portion 521 may be disposed proximate to the front side of the drawer 500, and the second horizontal portion 523 may be disposed in the middle of the drawer 500 sidewall. The second horizontal portion 523 may be disposed proximate to the rear end of the drawer 500.

Each tilting rib 520 may further include at least one inclined portion 522 enabling the drawer to tilt when pulled out. The drawer 500 may be pulled outward to any extended position as desired by the user.

Due to the inclined portion 522, the drawer 500 has the natural tendency to move inward. Thus, when the door 200 is being closed while the drawer 500 is still in an extended position (e.g., the drawer is left partially in unbeknownst to a user), the drawer can slide completely into the retracted position by the momentum of the moving door 200.

The tilting rib 520 may further include a first stopper 524 disposed proximate to the front side of the drawer 500 and has a shape conformal to the top of the guide projection 420. The rib 520 may also include a second stopper 525 disposed proximate to the rear side of the drawer 500 and operable to prevent the guide projection 420 from being uncoupled from the rail.

The first stopper 524 may be formed in a semi-circular shape open downward, and the second stopper 525 may be formed in a hook shape that is curved downward.

With reference to the bottom of the drawer 500, when the drawer is in an extended position, the front side of the first stopper 524 may be formed to be lower than the rear side of the first stopper 524 where the first horizontal portion 521 is connected.

With reference to the bottom of the drawer 500, the second stopper 525 is disposed at a higher position than the first stopper 524. Thus, the tilting rib 520 becomes increasingly higher from the front toward the back, which allows the drawer 500 to be effectively tilted when it is pulled outward.

The first stopper 524 or the second stopper 525 prevents the drawer 500 from being uncoupled from the housing 100, thereby allowing the drawer 500 to be reliably pushed in and pulled out by a user.

The height of the first stopper 524 is designed such that the drawer 500 is in a horizontal orientation when the first stopper 524 comes in contact with the guide projection 420.

As illustrated in FIG. 2, the bottom surface of the drawer 500 may have parallel grooves 540 to inhibit items (such as a bottle) stored in the drawer from moving excessively when the drawer is tilted. In FIG. 2, the groove portions 540 are formed perpendicular to side walls, but may also be formed in other directions in other embodiments.

Since the tilting rib 520 needs to support the weight of the drawer 500 and the accommodated items, at least two strength reinforcing portions 526 may be formed between the upper surface and the lower surface of the tilting rib 520 to improve durability.

The pair of guide rails 410 and the drawer 500 may be disposed in the refrigerating chamber 100*b* or the freezing chamber 100*a*. Although a pair of guide rails 410 is illustrated, additional guide rails 410 may be used in other embodiments.

An exemplary process of using the drawer 500 according to an embodiment of the present disclosure will be described below.

Figure 4:
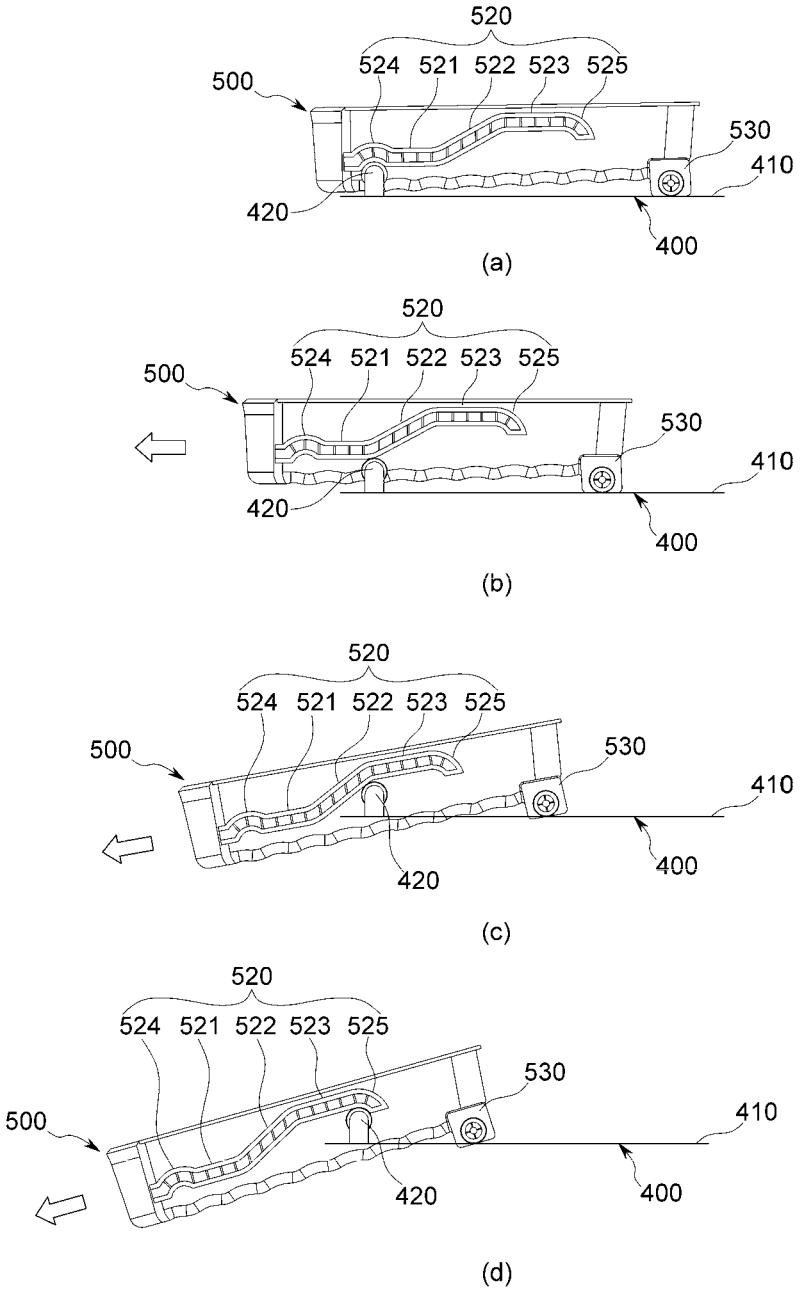
FIG. 4 illustrates the operational states of the exemplary drawer according to an embodiment of the present disclosure.

FIG. 4 illustrates various positions of the exemplary drawer 500 in use according to the embodiment of the present disclosure.

Referring to FIG. 4, in state (a), the drawer 500 sits completely inside the refrigerator in its retracted position. In this state, the lower surface of the drawer 500 is horizontal with reference to the refrigerator; the guide projection 420 is in contact with the first stopper 524; and the roller 430 remains still on the guide rail 410.

In state (b), the drawer 500 is pulled outward by a small distance. When the user pulls the drawer 500, the first stopper 524 is uncoupled from the roller 430 of the guide projection 420. By using the rollers 430 and the pair of wheels 510, friction noise that would occur when the drawer 500 move may be advantageously reduced. Further, a user may use a reduced force to move the drawer 500.

Thereafter, in state (c) the inclined portion of the tilting rib 520 is in contact with the guide projection 420 and the drawer 500 is tilted. At the transition between the inclined portion and the second horizontal portion, the guide projection 420 may be stopped, and the drawer 500 may stop sliding further unless an additional external force is applied by a user. If an intended item is disposed on the front side in the drawer 500, the user may stop pulling the drawer 500 and remove the item.

Thereafter, in state (d), the second horizontal portion runs on the guide projection. Once the guide projection 420 comes into contact with the aforementioned second stopper 525, the drawer 500 stops at its furthest permitted position.

It will be appreciated that the process of pushing the drawer 500 inward may be performed in a reverse order. The structures of the drawer 500 and the guide unit 400 according to the exemplary embodiment of the present disclosure advantageously require relatively small external forces to slide the drawer 500 in and out of the refrigerator. Because the drawer 500 can be tilted when pulled out, a user can position the drawer to a convenient height to access. Further the drawer 500 may slide to the retracted position when pushed by the moving door 200.

In summary, according to an exemplary method of using the refrigerator according to an embodiment of the present disclosure, the drawer 500 is pulled outward from its retracted position by the user. At this point, the first stopper 524 of the tilting rib 520 separates with the guide projection 420 of the guide unit 400. When the drawer is pulled further, the first horizontal portion 521 of the tilting rib 520 moves on the guide projection 420. When the inclined portion 522 comes into contact with the guide projection 420, the drawer 500 can tilt at a first tilting angle. When the second horizontal portion 523 moves on the guide projection 420, the drawer 500 is tilted at a second tilting angle. The guide projection 420 is blocked by the second stopper 525 such that the drawer 500 can no longer be pulled outward.

It will be appreciated that a process of pushing the drawer 500 inward may be performed in a reverse order.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A refrigerator comprising:

a housing comprising: a door; and opposite side walls;

guide units respectively coupled to the opposite side walls and comprising: a pair of guide rails; and guide projections extending upward from the pair of guide rails respectively; and a drawer coupled to the guide units and comprising a pair of tilting ribs configured to enable the drawer to tilt when the drawer is pulled outward from the housing along the pair of guide rails to an extended position, wherein each of the pair of tilting ribs comprises:

a first horizontal portion extending horizontally with reference to the refrigerator when the drawer is at a retracted position;

a second horizontal portion extending horizontally with reference to the refrigerator when the drawer is at the retracted position and positioned to be higher than the first horizontal portion; and an inclined portion disposed between the first horizontal portion and the second horizontal portion.

2. The refrigerator of claim 1, wherein the drawer further comprises a pair of wheels configured to move along the guide rails.

3. The refrigerator of claim 2, wherein the pair of wheels is disposed on the opposite side walls of the drawer.

4. The refrigerator of claim 1, wherein each of the guide projections further comprises a roller coupled to a lower surface of the tilting rib.

5. The refrigerator of claim 1, wherein the first horizontal portion is disposed on a front side of a sidewall of the drawer, and the second horizontal portion is disposed at a center of the sidewall of the drawer.

6. The refrigerator of claim 1, wherein each tilting rib further comprises:

a first stopper disposed proximate to a front side of the drawer and having a shape conformal to an upper surface of the guide projection; and a second stopper disposed proximate to a rear side of the drawer and configured to stop the drawer from being pulled outward further when the second stopper is in contact with the guide projection.

7. The refrigerator of claim 6, wherein, when the first stopper is in contact with the guide projection, the drawer is positioned horizontally and is in the retracted position.

8. The refrigerator of claim 6, wherein the first stopper has an arcuate or semi-circular shape that opens downward.

9. The refrigerator of claim 6, wherein the second stopper has a hook-like shape that opens downward.

10. The refrigerator of claim 1, wherein the tilting rib comprises at least two strength reinforcing portions formed between an upper surface and a lower surface of the tilting rib.

11. The refrigerator of claim 1, wherein the drawer further comprises a plurality of grooves formed on a bottom wall thereof.

* * * * *